US005545055A

United States Patent [19]

Tanaka et al.

[11] Patent Number: 5,545,055

[45] Date of Patent: Aug. 13, 1996

[54] METHOD AND APPARATUS FOR MECHANICALLY AND ELECTRICALLY COUPLING METAL TERMINALS IN A HOUSING

[75] Inventors: Seiji Tanaka; Shuji Kosuge; Kazuhiko Fuse, all of Yokkaichi, Japan

[73] Assignee: Sumitomo Wiring Systems, Ltd., Mie, Japan

[21] Appl. No.: 274,278

[22] Filed: Jul. 13, 1994

[30] Foreign Application Priority Data

Jul. 16, 1993 [JP] Japan ..... 5-199256

[51] Int. Cl.[6] ..... H01R 31/08

[52] U.S. Cl. ..... 439/507; 439/511; 439/189

[58] Field of Search ..... 439/507, 511, 439/189

[56] References Cited

U.S. PATENT DOCUMENTS

| | | | |
|---|---|---|---|
| 3,087,137 | 7/1961 | Linn | 439/507 |
| 5,007,888 | 4/1991 | Goutiere | 439/507 |
| 5,106,318 | 4/1992 | Endo et al. | 439/507 |
| 5,112,239 | 5/1992 | Yagi et al. | 439/511 |
| 5,201,667 | 3/1993 | Endo et al. | 439/189 |
| 5,356,302 | 10/1994 | Inoue et al. | 439/189 |

FOREIGN PATENT DOCUMENTS

| | | |
|---|---|---|
| 0387772 | 9/1990 | European Pat. Off. . |
| 2923035 | 12/1980 | Germany . |
| 61-277180 | 12/1986 | Japan . |
| 63-308884 | 12/1988 | Japan . |
| 9014702 | 11/1990 | WIPO . |

*Primary Examiner*—David L. Pirlot
*Assistant Examiner*—T. C. Patel
*Attorney, Agent, or Firm*—Oliff & Berridge

[57] ABSTRACT

Three male terminals are inserted respectively into terminal receiving chambers in a male connector housing and a bus bar is inserted into the terminal receiving chambers through a through-hole. As a result, the insertion side portion of the bus bar is press-fitted in reception grooves in bus bar press-fitting portions disposed beneath the through-hole. Thus, the insertion side portion of the bus bar is received in the reception grooves in the three male terminals, and is mechanically fixed to and electrically connected to the male terminals, so that three insulated wires connected respectively to the male terminals are connected together only at the male connector housing.

11 Claims, 3 Drawing Sheets

METHOD AND APPARATUS FOR MECHANICALLY AND ELECTRICALLY COUPLING METAL TERMINALS IN A HOUSING

BACKGROUND OF THE INVENTION

This invention relates to a connector terminal-joint structure for connecting a plurality of terminals together.

For connecting insulated wires, juxtaposed in the same direction, there have been used previously either a branch connection (also called "joint") or a technique utilizing a branch connection box.

Here, the branch connection relates to a technique in which an insulative covering is peeled from one insulated wire intermediate opposite ends thereof to thereby expose its conductor, and an insulative covering is peeled from a front end portion of the other insulated wire to thereby expose its conductor, and the two conductors are compressively clamped together by a compressively-clamping terminal to thereby make an electrical and mechanical connection between the conductors.

One conventional branch connection box has been proposed, for example, in Japanese Patent Unexamined Publication No. 61-277180. More specifically, insulated wires, each having a female terminal connected to its front end, are inserted at their front end portions into a connector housing having a plurality of terminal receiving chambers, and a plurality of male terminals, which can be inserted respectively into the female terminals disposed respectively in the above terminal receiving chambers, are provided at the branch connection box that can receive the connector housing therein. The male terminals are connected respectively to their mating female terminals.

In this construction, the female terminals are connected respectively to the front ends of the insulated wires to be connected together and are inserted respectively into the terminal receiving chambers of the connector housing. Then, when the connector housing is inserted into the branch connector box, the male terminals, connected together at the branch connection box, are inserted respectively into their mating female terminals, so that the plurality of female terminals and hence the insulated wires are electrically connected together through the male terminals.

In the above technique of achieving the connection by the branch connection, however, cumbersome operations such as the peeling of the insulative coverings and the compressive clamping of the terminals, have been required, and therefore it has been difficult to introduce an automated system, thus resulting in low operation efficiency.

The technique utilizing the branch connection box, in addition to the connector housing, requires a separate branch connection box, and therefore extra space for mounting the box is required. When this is to be installed, for example, in an engine room or compartment of an automobile, there has been encountered a problem that the efficiency of mounting is poor. In addition, the branch connection box requires the box to be affixed to a car body or the like by tape or a bracket. This has resulted in a problem that the number of steps of the assembling operation is increased.

SUMMARY OF THE INVENTION

The present invention has been made in view of the above problems, and an object of the invention is to provide a joint structure and method for connecting terminals for connector terminals in which predetermined terminals can be electrically and mechanically connected in a connector housing.

According to one aspect of the invention, there is provided a connector terminal-joint structure for connecting metal terminals received in a plurality of respective terminal receiving chambers formed in a connector housing, comprising a through-hole formed in the connector housing and extending in a direction intersecting a direction of a length of the terminal receiving chambers in the connector housing, the through-hole communicating with each of the terminal receiving chambers; a reception portion provided on that portion of each of the metal terminals, the reception portion being registrable with the through-hole and being formed along the through-hole; and a short-circuiting piece abutted against the reception portions through the through-hole to electrically short-circuit the predetermined metal terminals together.

According to another aspect of the invention, there is provided a connector for mechanically and electrically connecting coupling metal terminals comprising a housing having terminal receiving chambers for receiving respective ones of the metal terminals and a through-hole formed in said housing that communicates with each of the terminal receiving chambers, and a bus bar having a length equal to a length of said through-hole that is adapted to pass through the through-hole to the terminal receiving chambers to engage with reception portions formed on each of the metal terminals.

According to yet another aspect of the invention, there is provided a method of mechanically and electrically coupling metal terminals having reception pieces and a connector having a housing that has terminal receiving chambers and a through-hole that communicates the terminal receiving chambers, and a bus bar, the method comprising the steps of inserting the metal terminals into respective ones of the terminal receiving chambers, aligning reception grooves formed on the reception pieces with the through-hole, passing the bus bar through the through-hole and engaging each of the reception grooves with the bus bar.

In the invention of the above construction, the short-circuiting piece, abutted against the reception portions of the metal terminals through the through-hole in the connector housing, electrically short-circuits the predetermined metal terminals together. Therefore, the plurality of metal terminals received in the common connector housing are electrically connected together.

As described above, in the present invention, the predetermined terminals can be connected together only at the connector housing, and the single connector that has a first function of an ordinary connector to connect one connector to other connector and a second function of a joint connector, and therefore enhanced versatility is obtained.

Moreover, because a cumbersome operation such as a branch connection is eliminated, an automation system can be easily introduced, and the efficiency of the wire installation can be enhanced.

Furthermore, a separate branch connection box or the like other than the connector housing is eliminated, and the operation for fixing such member is not necessary. Therefore, the mounting efficiency is excellent and also the number of steps of the assembling operation is reduced. This is quite advantageous particularly when the connector is to be installed at a limited mounting space as within an engine compartment or room of an automobile.

BRIEF DESCRIPTION OF THE DRAWINGS

The invention will be described in detail with reference to the following drawings, wherein.

DESCRIPTION OF PREFERRED EMBODIMENTS

Figure 1:
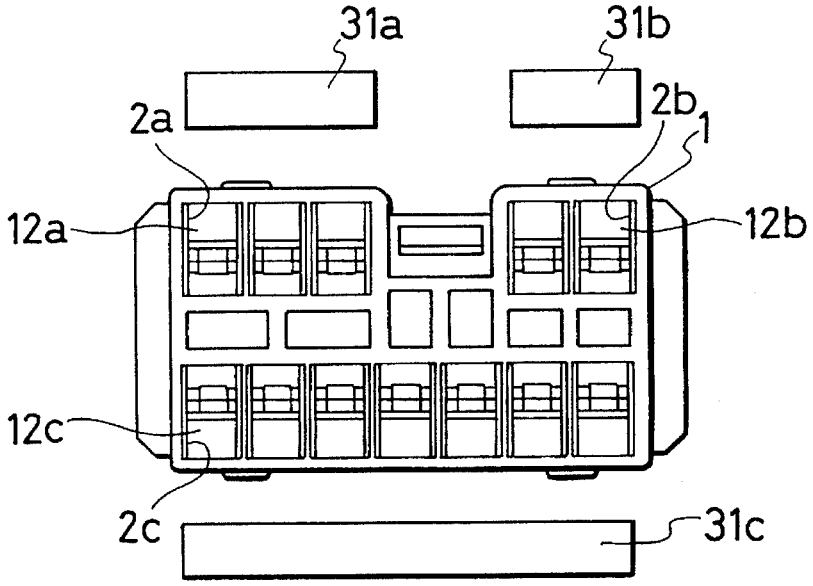
FIG. 1 is a front-elevational view showing a male connector housing and bus bar pieces.
Figure 2:
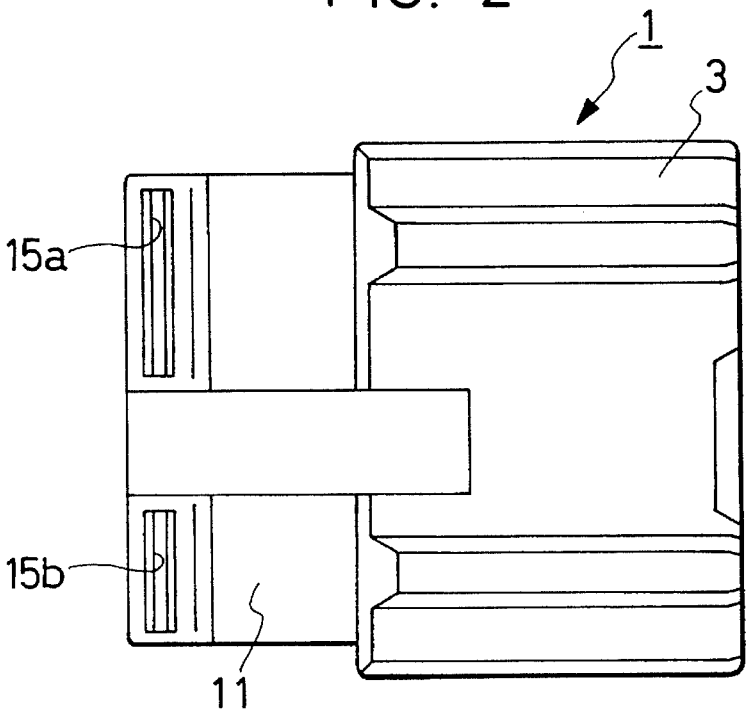
FIG. 2 is a plan view of the male connector housing.
Figure 3:
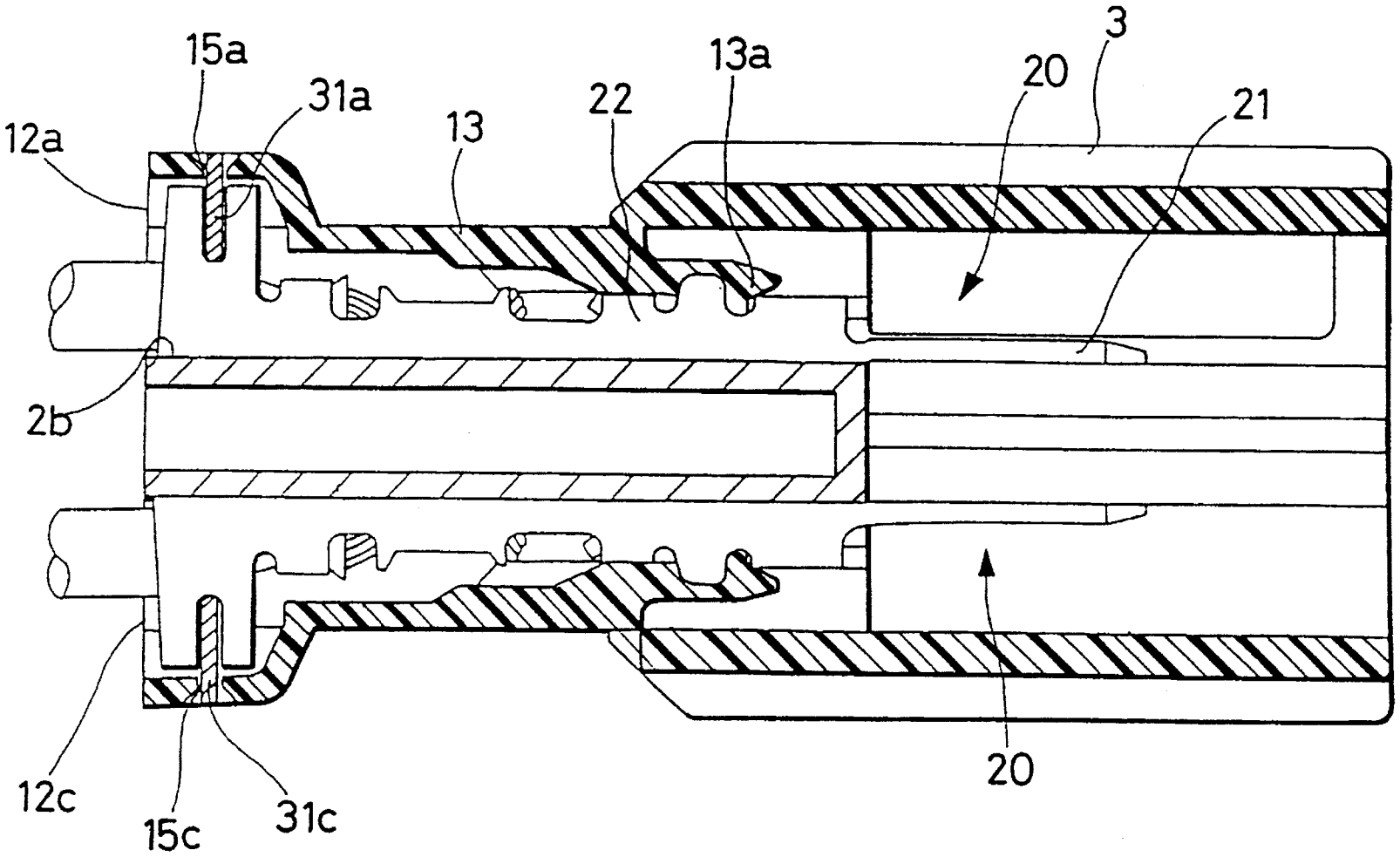
FIG. 3 is a side cross-sectional view of the male connector housing having male terminals and the bus bar pieces mounted thereon.

A preferred embodiment of the present invention will now be described in detail with reference to the drawings. In FIGS. 1 to 3, a male connector housing 1 includes a terminal holder portion 11, the interior of which is partitioned in such a manner that three terminal receiving chambers 2*a* plus two terminal receiving chambers 2*b* are provided at an upper portion thereof whereas seven terminal receiving chambers 2*c* are provided at a lower portion thereof. A hood portion 3 is provided forwardly of the terminal holder portion 11, and terminal insertion holes 12*a*, 12*b* and 12*c* are provided rearwardly of the terminal holder portion 11. Male terminals 20 are received in the terminal receiving chambers 2*a*, 2*b* and 2*c*, respectively, and a female connector housing (not shown) is inserted into the hood portion 3 of the male connector housing 1, so that female terminals are fitted on and connected to their mating male terminals 20, respectively.

An elastic lock piece 13 having a lock pawl 13*a* is provided in each of the terminal receiving chambers 2*a*, 2*b* and 2*c*, the lock pawl being disposed in the terminal receiving chamber.

A slit-like through-hole 15*a* is formed through an upper wall of the male connector housing 1 adjacent an open end of the terminal holder portion 11, and extends across the terminal receiving chambers 2*a*, the through-hole 15*a* being in communication with the terminal receiving chambers 2*a*. Similarly, a through-hole 15*b* is formed in communication with the two terminal receiving chambers 2*b*. A through-hole 15*c* is also formed through the lower wall, and is in communication with the terminal receiving chambers 2*c*.

Bus bar pieces (short-circuiting pieces) 31*a*, 31*b* and 31*c* each in the form of a generally rectangular, electrically-conductive plate, are inserted into the through-holes 15*a*, 15*b* and 15*c*, respectively. The bus bar piece 31*a* connects the three male terminals 20, inserted respectively in the terminal receiving chambers 2*a*, together mechanically and electrically in a manner mentioned below, and similarly the bus bar piece 31*b* connects the two male terminals 20, inserted respectively in the terminal receiving chambers 2*b*, together, and the bus bar piece 31*c* connects the seven male terminals 20, inserted respectively in the terminal receiving chambers 2*c*, together.

Figure 4:
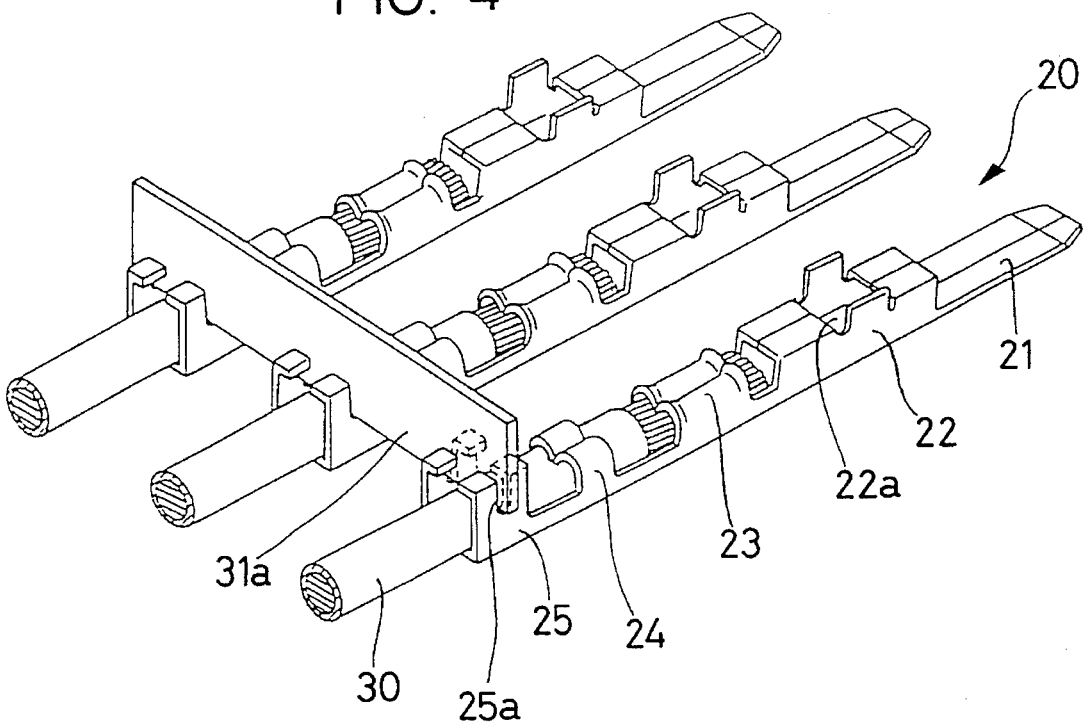
FIG. 4 is a perspective view showing a condition in which the bus bar piece is inserted in one set the male terminals.

As shown in FIG. 4, a front end portion of the male terminal 20 is formed into a terminal portion 21, and a tubular barrel portion 22 of a square cross-section extends continuously from this terminal portion. An upper surface of the barrel portion 22 is open at its central portion to provide a locking notch or lock hole 22*a* in which the above-mentioned lock piece is engageable. A wire barrel 23 for connection to a conductor of an insulated wire 30 is formed rearwardly of the barrel portion 22, and an insulation barrel 24 for fastening a covering of the insulated wire 30 is formed rearwardly of the wire barrel 23. Further, a reception portion for receiving the bus bar piece 31*a* is formed rearwardly of the insulation barrel 24 of the male terminal 20. This reception portion 25 comprises opposed side portions of an inverted L-shape that allow the insulated wire 30 to pass therebetween, and a reception groove 25*a* is formed in each of the opposed side portions and extends downwardly from its upper end. The bus bar piece 31*a* can be press-fitted in these reception grooves 25*a* to form an interference fit. When the male terminal 20 is inserted into the male connector housing 1, the reception grooves 25*a* are disposed in registry with the through-hole 15*a* formed in the male connector housing 1.

Next, the operation of this embodiment of the above construction will now be described.

Here, three insulated wires 30 are to be connected together. The front end of the insulated wire 30 is compressively clamped by the wire barrel 23 of the male terminal 20, and the covering of the insulated wire is compressively clamped by the insulation barrel 24. Then, each male terminal 20 is inserted into the corresponding terminal receiving chamber 2*a* through the terminal insertion hole 12*a*. As the male terminal 20 is inserted, the front end of the barrel portion 22 abuts against the lock pawl 13*a* of the lock piece 13 to force it upwardly, and when the male terminal is inserted into a predetermined position within the terminal receiving chamber 2*a*, the lock pawl 13*a* becomes received and engaged in the lock hole 22*a*, thereby primarily retaining the male terminal 20 in this position.

When all of the three male terminals 20 are inserted in the same manner, the bus bar piece 31*a* is inserted into the terminal receiving chambers 12*a* through the through-hole 15*a*. As a result, the insertion side portion of the bus bar 31*a* is press-fitted in the reception grooves 25*a* of the reception portions 25 disposed beneath the through-hole 15*a*.

Namely, the insertion side portion of the bus bar piece 31*a* is received in the reception grooves 25*a* of the three male terminals 20, and is mechanically fixed to and electrically connected to these male terminals 20, as shown in FIG. 4. Therefore, the insulated wires 30 connected respectively to the male terminals 20 are connected together. Upon insertion of the bus bar piece 31*a*, the upper edge portion of the bus bar piece 31*a* is engaged with the edges of the through-hole 15*a*, thereby secondarily retaining the male terminals 20, thus positively fixing the male terminals 20 relative to the male connector housing 1.

Similarly, the two male terminals 20, inserted respectively into the terminal receiving chambers 2*b*, are connected together by the bus bar piece 31*b*, and the seven male terminals 20, inserted respectively into the terminal receiving chambers 2*c*, are connected together by the bus bar piece 31*c*.

In the above embodiment, the predetermined male terminals 20 can be connected together only at the male connector housing 1, and the single connector performs the function of an ordinary connector connectable to other connector and the function of a joint connector, and therefore enhanced versatility is obtained.

Moreover, since a cumbersome operation such as a branch connection is not needed, an automated system can be easily introduced and the efficiency of the wire installation can be enhanced.

Furthermore, a separate branch connection box or the like other than the male connector housing I is not necessary, and the operation for fixing such member is not necessary, and therefore the mounting efficiency is excellent, and also the number of steps of the assembling operation is reduced. This is quite advantageous particularly when the connector is to be installed at a limited mounting space as within an engine room or compartment of an automobile.

Moreover, the male terminals 20 can be retained not only primarily by the lock piece 13 but also secondarily by the bus bar pieces 31*a*, 31*b*, 31*c*, so that the terminal can be positively fixed.

In this embodiment, although the male terminal 20 has the reception portion 25 with the reception grooves 25*a*, the construction is not limited to such an arrangement. For example, a flat abutment portion may be formed on that portion of the male terminal 20 abuttable with the insertion side of the bus bar piece 31*a* to make an electrical connection thereto, in which case the male terminals 20 are electrically connected together through abutment of the abutment portion against the bus bar piece 31*a*.

Figure 5:
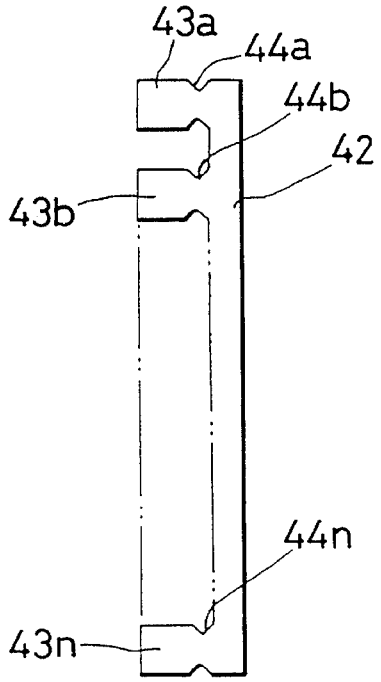
FIG. 5 is a front-elevational view of an alternative form of the bus bar piece.

In this embodiment, although the bus bar pieces 31*a*, 31*b* and 31 are in the form of a generally rectangular plate, they are not limited to such a shape, and for example, the bus bar pieces may have such a configuration as shown in FIG. 5. More specifically, this bus bar piece 41 comprises a strip portion 42 of a generally strip shape, and a plurality of projection portions 43*a*, 43*b* . . . and 43*n* projected from the strip portion 42 in the same direction (toward the male terminals 20). Narrow portions 44*a*, 44*b* . . . and 44*n* are formed respectively at connecting portions interconnecting the projection portions 43*a*, 44*b* . . . and 43*n* and the strip portion 42.

With this configuration of the bus bar piece 41, only those projection portions corresponding respectively to those male terminals 20 to be short-circuited together are kept intact while the other projection portions are broken along narrow portions 44*a* . . . 44*n* and removed by a tool such as a pliers, and then the bus bar piece is inserted into the through-hole. As a result, only those male terminals corresponding respectively to the intact projection portions can be connected together, and a desired combination of the male terminals to be connected can be obtained. Thus, with this configuration of the bus bar piece 41, various connections can be achieved only by preparing a plurality of bus bar pieces 41, and this further enhances versatility.

The invention has been described in detail with reference to preferred embodiments thereof, which are intended to be illustrative but not limiting. Various changes may be made without departing from the spirit and scope of the invention, which is defined in the following claims.

What is claimed is:

1. A connector terminal-joint structure for connecting metal terminals that are received in a plurality of respective terminal receiving chambers formed in a connector housing comprising:

a through-hole formed in said connector housing and extending in a direction intersecting a direction of a length of said terminal receiving chambers in said connector housing, said through-hole communicating with each of said terminal receiving chambers;

a reception portion on each of said metal terminals, said reception portion being registrable with said through-hole and being formed along said through-hole, said metal terminals each being connected to a wire, the reception portion being located over an insulated portion of the wire; and a short-circuiting piece abutted against said reception portions through said through-hole to electrically short-circuit the metal terminals together.

2. A connector for mechanically and electrically coupling metal terminals within a housing having terminal receiving chambers for receiving respective ones of said metal terminals comprising:

a through-hole formed in said housing that communicates with each of said terminal receiving chambers; and a bus bar having a length equal to a length of said through-hole that is adapted to pass through said terminal receiving chambers and engage with reception portions formed on each of said metal terminals, said metal terminals each being connected to a wire, the reception portion being located over an insulated portion of the wire.

3. The connector of claim 2, wherein each of said terminal receiving chambers includes a terminal insertion hole that includes an elastic lock piece and retaining pawl assembly that is engageable with a locking notch formed on corresponding ones of said metal terminals.

4. The connector of claim 2, wherein the bus bar comprises a generally rectangular metallic strip.

5. The connector of claim 2, wherein the bus bar comprises a strip portion having a plurality of spaced projection portions that are communicable with said terminal receiving chambers and engageable with said reception portions.

6. The connector of claim 5, wherein each of said projection portions is connected to said strip portion with a narrowed portion.

7. The connector of claim 6, wherein selected ones of projection portions are broken along said narrow portion to define a predetermined pattern of metal terminals to be engaged.

8. A method of mechanically and electrically coupling metal terminals having reception pieces in a connector having a housing that has terminal receiving chambers and through-hole that communicates with said terminal receiving chambers, the method comprising the steps of:

inserting metal terminals into respective ones of said terminal receiving chambers, said terminals each being connected to a wire;

aligning reception grooves formed on said reception pieces with the through-hole, said reception grooves being located over an insulated portion of the wire;

passing a bus bar through said through-hole; and engaging each of said reception grooves with said bus bar.

9. The method of claim 8, wherein each of the terminal receiving chambers includes an elastic lock piece and pawl assembly that is engageable with a locking notch formed on end of said metal terminals, and the inserting step includes coupling said pawl with said locking notch.

10. The method of claim 8, wherein the method further comprises providing the bus bar with a plurality of frangibly breakable projection portions and breaking selected ones of said projection portions to form a configuration that corresponds a pre-selected configuration of said metal terminals to be connected.

11. The method of claim 8, wherein the engaging step further includes providing an interference fit between the bus bar and the retaining groove.

* * * * *